US008167513B2

(12) United States Patent
Ryan

(10) Patent No.: US 8,167,513 B2
(45) Date of Patent: May 1, 2012

(54) POTHOLE PATCHING MACHINE

(76) Inventor: Bill Ryan, Grimsby (CA)

( * ) Notice: Subject to any disclaimer, the term of this patent is extended or adjusted under 35 U.S.C. 154(b) by 2 days.

(21) Appl. No.: 12/792,311

(22) Filed: Jun. 2, 2010

(65) Prior Publication Data

US 2010/0322710 A1 Dec. 23, 2010

Related U.S. Application Data

(60) Provisional application No. 61/218,126, filed on Jun. 18, 2009.

(51) Int. Cl.
*E01C 23/02* (2006.01)

(52) U.S. Cl. ..... 404/75; 404/101; 404/102; 404/107; 404/108; 404/109

(58) Field of Classification Search ..... 404/72, 404/75, 107, 108
See application file for complete search history.

(56) References Cited

U.S. PATENT DOCUMENTS 3,217,620 A * 11/1965 Mindrum et al. ..... 404/90
3,625,120 A * 12/1971 Nagy ..... 404/107
3,820,914 A * 6/1974 Zimmerman ..... 404/110
4,676,689 A * 6/1987 Yant ..... 404/110
4,830,533 A * 5/1989 Miller ..... 404/101
5,131,788 A * 7/1992 Hulicsko ..... 404/108
5,236,275 A * 8/1993 Kneeland et al. ..... 404/75
5,251,999 A * 10/1993 McCracken ..... 404/109
5,333,969 A * 8/1994 Blaha et al. ..... 404/91
5,419,654 A * 5/1995 Kleiger ..... 404/101
5,584,597 A * 12/1996 Lemelson ..... 404/83
5,752,782 A * 5/1998 Hulicsko ..... 404/103
6,809,294 B2 * 10/2004 Velinsky et al. ..... 219/213
7,201,536 B1 * 4/2007 Westbrook et al. ..... 404/108
7,481,601 B2 * 1/2009 Gilchrist ..... 404/109
7,654,772 B1 * 2/2010 Zimmerman ..... 404/108
2003/0142579 A1 * 7/2003 Throop ..... 366/3
2009/0274515 A1 * 11/2009 Cooper et al. ..... 404/72
2011/0085860 A1 * 4/2011 Gregerson ..... 404/107

* cited by examiner

*Primary Examiner* — Raymond W Addie

(57) ABSTRACT

A pothole patching machine includes a container for storage of patch material, and a auger screw conveyor for conveying the patch material from the container to a ram. The ram is adapted to forcibly urge the patch material into a pothole. The ram is moveable between a retracted position and an extended position which completes one fill stroke. The ram also includes a foot plate dimensioned for positioning over the pothole and sensors for sensing when the pothole has been filled.

9 Claims, 7 Drawing Sheets

191
144
142
124
146
100
130
132
102
110
193

100
122
116
124
118
120
114
130
102
112
108
110
104
106

POTHOLE PATCHING MACHINE

The applicant claims priority from U.S. provisional patent application 61/218,126 titled POTHOLE PATCHING MACHINE, which was filed on Jun. 18$^{th}$, 2009 by Bill Ryan.

FIELD OF THE INVENTION

The present device relates generally to machines used to fill potholes in paved roads and more particularly relates to a semi-automated pothole patching machine.

BACKGROUND OF THE INVENTION

U.S. Pat. No. 5,131,788 entitled Mobile Pothole Patching Vehicle filed by Leslie Huliesko issued on Jul. 21, 1992 and filed on Sep. 28, 1990. This patent describes a mobile pothole patching vehicle which conveys patching material from a container in a vehicle to the area that needs to be repaired. Thereafter a vehicle mounted tamping device tamps the patched material into the pothole that is to be filled. This machine relies on operator accuracy to ensure that the patching material is placed in the proper location and thereafter a tamper is used to level the material ensuring that there is a smooth surface. The draw back to the Heliesko device is that directing the patching material into the hole can be somewhat difficult and likely creates a lot of patch material waste. Secondly there is no control over the amount of tamping and/or pressure that is placed onto the patch material in the pothole other than sight of the operator utilizing the tamping device.

There is a need for a machine, which can quickly, easily and accurately and inexpensively place patching material into the pothole and compress the material to the surface level of the road surface to ensure a smooth finish without creating a lot of patching material waste.

BRIEF DESCRIPTION OF THE DRAWINGS

The device will now be described by way of example only with reference to the following drawings in which.

DETAILED DESCRIPTION OF THE PREFERRED EMBODIMENT

Figures 1, 2:
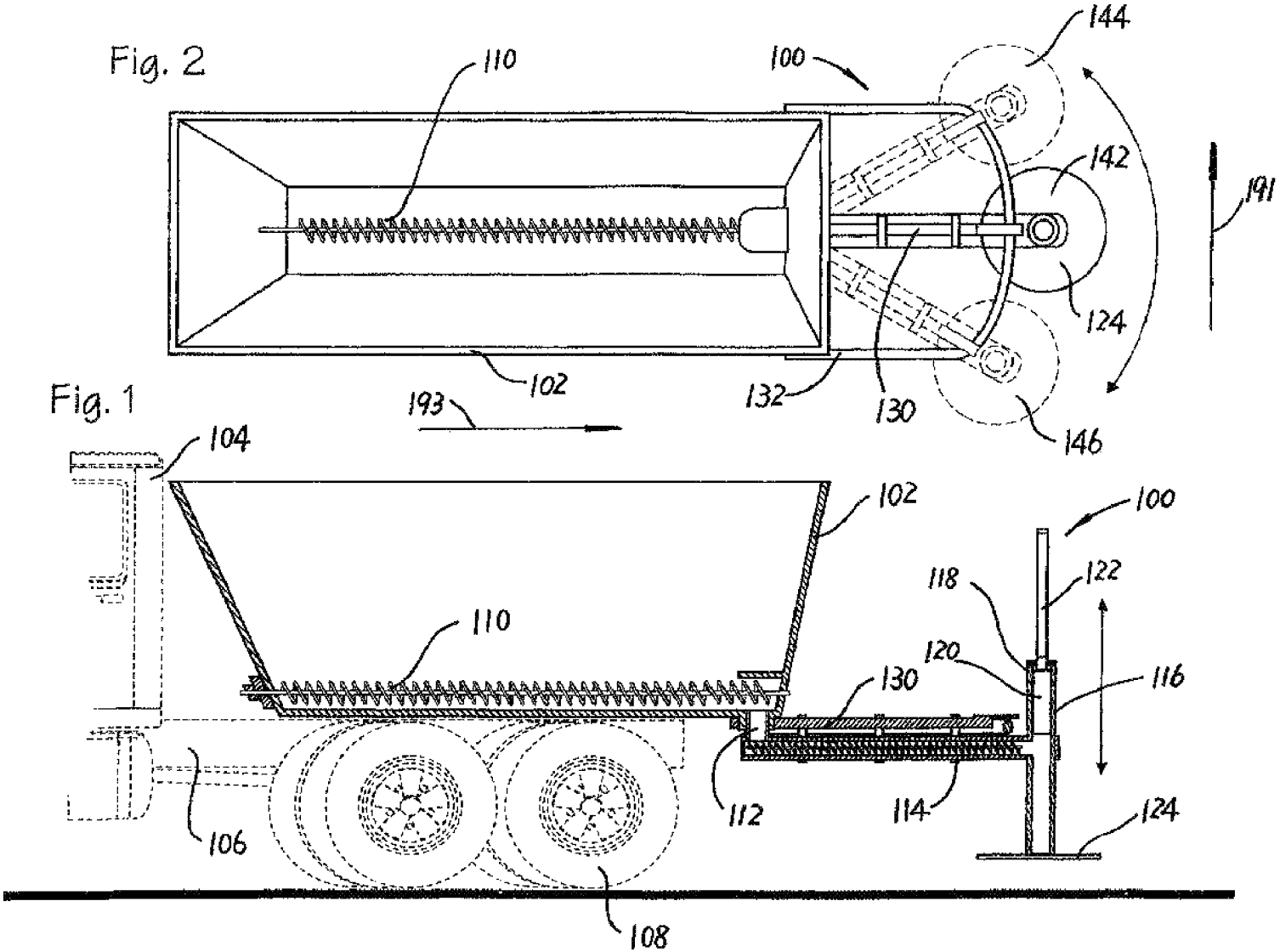
FIG. 1 is a side elevational view of a pothole patching machine deployed onto a vehicle, the vehicle shown in dashed lines.
FIG. 2 is a top plan view of the pothole patching machine shown in FIG. 1.

Referring first of all to FIGS. 1 through 5, pothole patching machine 100 includes the following major components namely a container 102 which is mounted onto a vehicle 104 which is not part of the pothole patching machine but is shown in dashed lines to understand that the pothole patching machine 100 can be deployed onto a vehicle 104. Vehicle 104 normally some type of a truck usually contains a truck frame 106 and truck wheels 108.

Container 102 is normally mounted onto truck frame 106 and will hold patching material not shown in the diagrams. Container 102 may include a heating device not shown in order to maintain the content of container 102 at a predetermined temperature. Patch material 160 can be in the form of hot asphalt or a mixture of liquid rubber and asphalt and/or any other suitable composition which is useful for patching potholes 125 in pavements 182. Container 102 has mounted therein an auger 110 which feeds the patch material into a discharge port 112 and drops it into a screw conveyor 114. Screw conveyor 114 is connected to ram 116 which includes a cylinder 118, a piston 120, a cylinder rod 122 and a foot plate 124.

Not shown is the actuation device for the cylinder rod 122 but can be of any kind known in the art including pneumatic, hydraulic and/or other types of mechanical actuation. Ram 116 is mounted onto a support arm 130 which in turn is mounted onto a support bracket 132 which is connected to container 102 and/or to vehicle 104.

Figure 5:
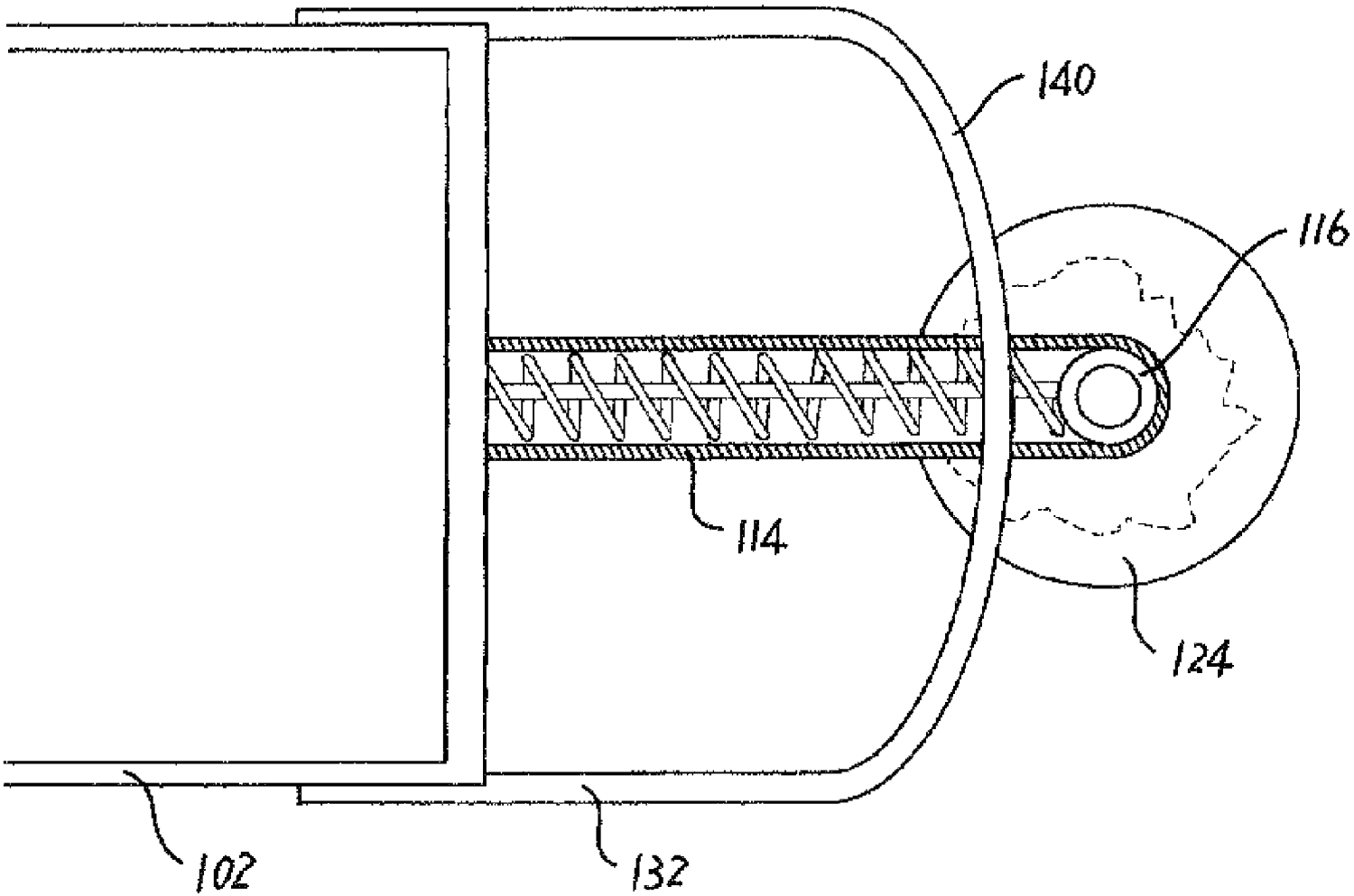
FIG. 5 is a partial top plan view of the pothole patching machine showing only a portion of the container.

Referring now to FIGS. 2 and 5, ram 116 is guided and attached to curved track portion 140 which is the rear most portion of support bracket 132. Shown in dotted lines in FIG. 2 foot plate 124 can be moved into central position 142, a left position 144 or a right position 146 or any intermediate position between left position 144 and right position 146 along curved track portion 140 of support bracket 132. Screw conveyor 114 is pivotally mounted at discharge port 112 so as to allow the movement of the ram 116 and the attached foot plate 124 along the curved track portion 140 of support bracket 132.

Figure 3:
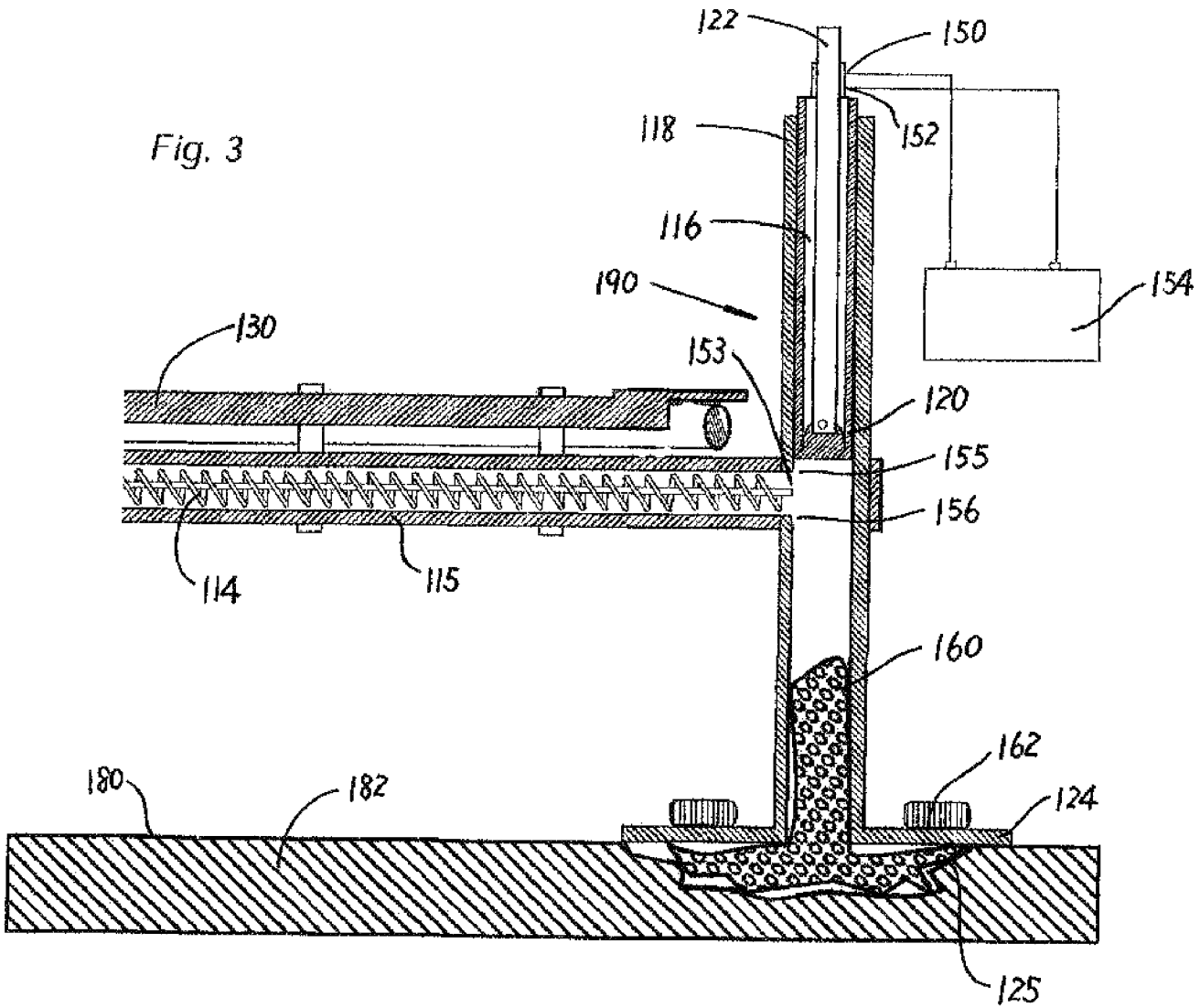
FIG. 3 is a side schematic partial cut away view of a portion of the pothole patching machine showing the ram, foot plate, and screw conveyor wherein the foot plate is placed onto the road surface of a pavement, the ram is shown in the retracted position.
Figure 4:
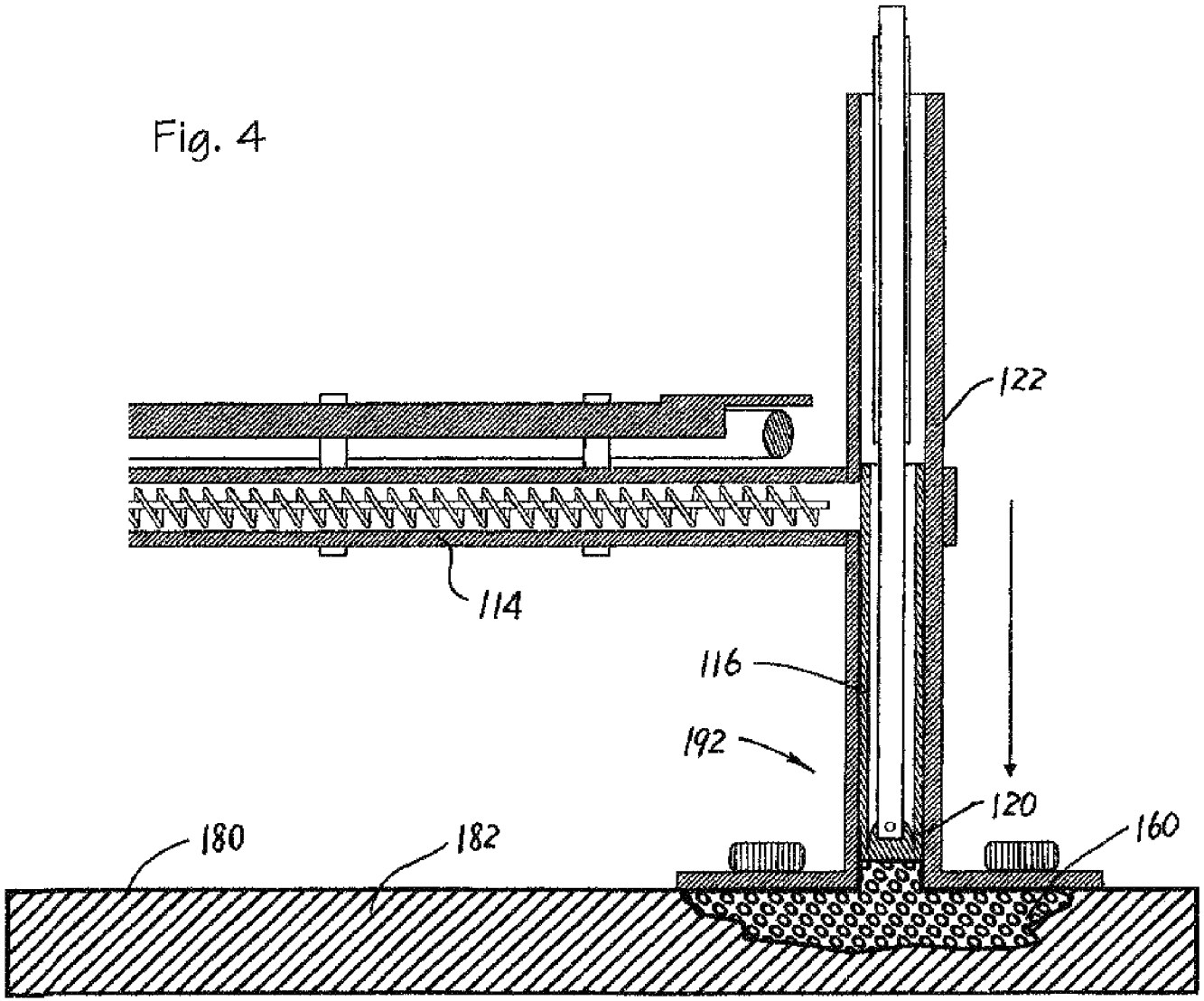
FIG. 4 is a side schematic partial cut away view of the pothole patching machine similarly as shown in FIG. 3, wherein the ram is in a partially extended position.

Now referring more specifically to FIGS. 3 and 4, ram 116 is shown in a retracted position 190 clear of opening 153, thereby allowing patch material 160 to travel through conveyor pipe 115 of screw conveyor 114 and be deposited and fall into cylinder 118 of ram 116.

In FIG. 3 for example, foot plate 124 is shown over a pothole 125. A predetermined amount of patch material 160 has been deposited partially into pothole 125 and partially into the bottom half of cylinder 118. Foot plate 124 is placed over top of pothole 125 thereby covering over the damaged area.

Foot plate 124 will align itself with the road surface 180 of pavement 182.

In FIG. 3 a computer control 154 is shown schematically which communicates with sensors in ram 116. For example a position sensor 150 and force sensor 152 is shown schematically on ram 116.

As piston 120 of ram 116 is forcibly lowered down onto patch material 160, it will force the material and compress it into the cavity of pothole 125 thereby filling up pothole 125 with patch material 160. The movement of the piston from a retracted position 190 to an extended position which may include the piston travelling beyond the bottom of the foot plate 124 is one fill stroke. It is contemplated that in most instances more than one fill stroke is required to completely fill the pot hole.

Referring now to FIG. 4, ram 116 is shown in a partially extended position 192 wherein piston 120 is almost at the bottom of foot plate 124. During this process the computer control 154 will monitor force 152 on ram 116 and also the position of the bottom of piston 120 relative to the bottom of foot plate 124 which is aligned with the top of road surface 180 of pavement 182. It is contemplated in this system that in the first fill stroke patch material is fed into ram 116 wherein the piston 120 will travel to below the bottom of foot plate 124 and partially into pothole 125. In other words in the first fill stroke there usually is not enough patch material fed into the ram 116 to completely fill pot hole 125. The computer control system 154 will sense this with a position sensor 154 and thereby calculate that more material is required in order to completely fill the pothole 125.

With calculations of force measured by force sensor 152 and of position measured by position sensor 154, one is able to calculate and/or approximate the amount of material that must yet be added in order to bring the level of patch material equal to the road surface 180 of pavement 182 under a certain predetermined amount of force measured by force sensor 152. Therefore on the next retracted position 190 a certain predetermined amount of patch material is fed into ram 116 and once again compacted into pothole 125 until such time as a predetermined position and force are obtained. The computer control system 154 will detect that the pothole is full and that the patch material 160 has been compacted to a certain predetermined specification. The position sensor is also adapted to measure how far the piston has moved past the bottom of the foot plate indicating the pothole has not been completely filled. In this case additional strokes of the ram are required to fill the pot hole.

In other words the computer control is adapted to estimate the amount of patch material required to just fill the pot hole in the next fill stroke based on the amount of patch material, the force measurements and the stroke measurements of the previous fill stroke.

Therefore on the next retracted position 190 a certain predetermined amount of patch material is fed into ram 116 and once again compacted into pothole 125 until such time as a predetermined position and force are obtained. The computer control system 154 will detect that the pothole is full and that the patch material 160 has been compacted to a certain predetermined specification.

The following are the steps in a method of patching potholes:

a) preselecting an amount of patch material for loading into the ram that will under fill the pothole;
b) forcible urge the patch material into the pothole using the ram which is moveable between a retracted position and an extended position and includes a cylinder and a piston;
c) measure the force on the ram as it travels from the retracted position to the extended position;
d) measure the position of the cylinder relative to the top of the road surface;
e) calculate the amount of patch material required to just fill the remainder of the pothole from the force and position information;
f) load the ram with an amount of patch material calculated to fill the remaining unfilled portion of the pothole;
g) repeat steps b to e.
h) in the event the pothole is still not completely filled repeat steps e to g above.

In addition vibrators 162 may be attached to the top of foot plate 124, thereby allowing one to vibratory as well as with ram force urge the patching material 160 into the cavity of pothole 125.

Patch material 160 can be of any kind which can be suitably used with this equipment. It must be capable of being moved along by auger 110 into the discharge port 112 and thereafter moved along the screw conveyor 114 along conveyor pipe 115 into cylinder 118 and there after capable of being compressed by ram 116 into pothole 125.

For example a hot asphalt based type patching material may suitably be used with this equipment. Optionally heating equipment to heat the patch material may be added but not shown in the drawings.

Foot plate 124 can be moved side to side in a lateral direction 191 along the curved track portion 140, thereby one is able to position foot plate 124 over a pothole 125 from the one extreme left position 144 to the extreme right position 146. In addition, vehicle 104 is capable of moving in the longitudinal direction 193, thereby the operator is able to exactly position foot plate 124 over top of pothole 125.

Opening 153 has an open upper lip 154 which the piston 120 must clear in order to allow material 160 to fall into cylinder 118. In addition opening 153 also has an opening lower lip 156 which when piston 120 passes thereby, prevents further conveyance of patch material 160 into cylinder 118.

Figures 6, 7:
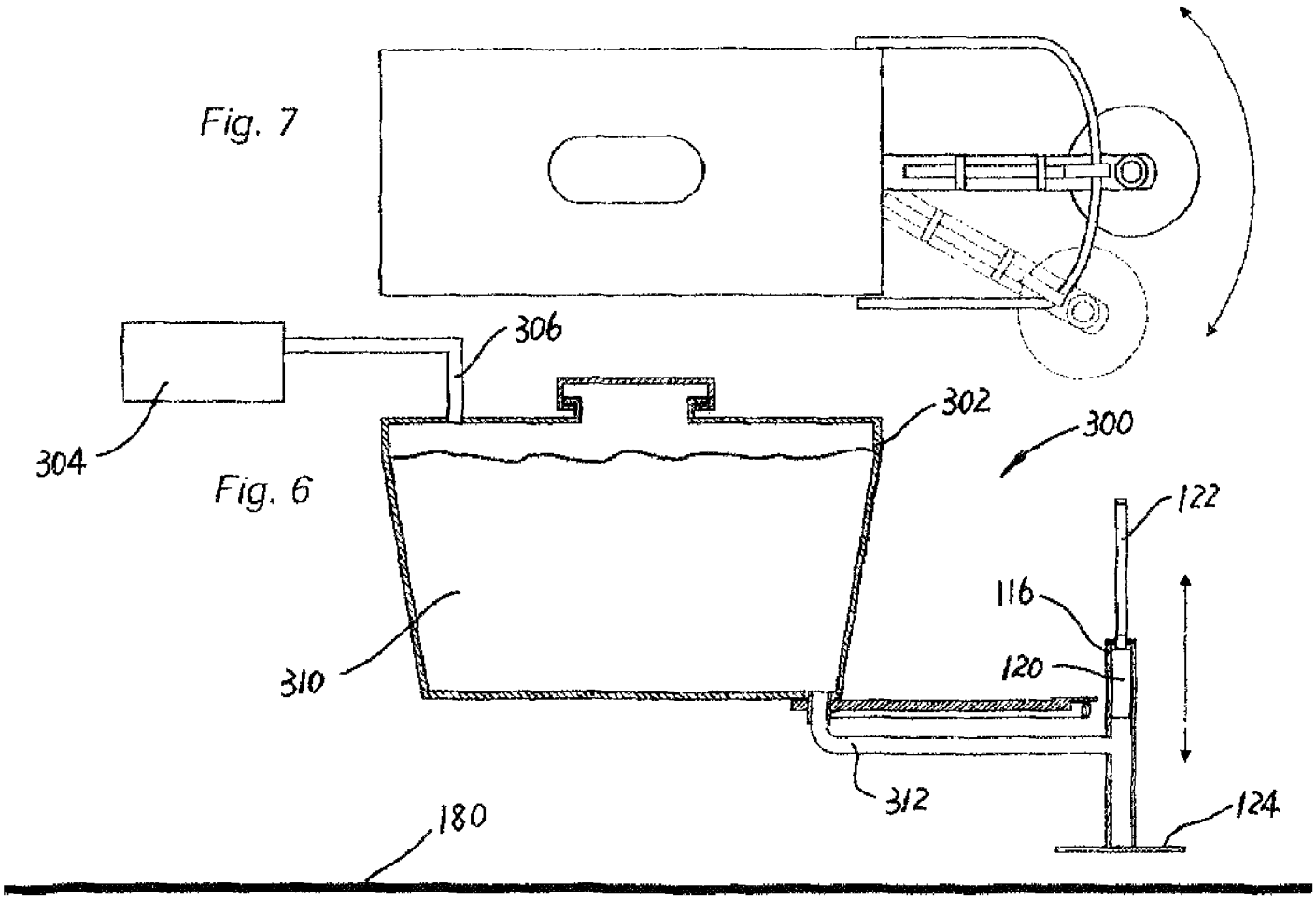
FIG. 6 is a schematic side elevational view of an alternate embodiment of the pothole patching machine shown using a pressure vessel.
FIG. 7 is a partial top plan view of the pothole patching machine shown in FIG. 6.

Referring now to FIGS. 6 and 7, an alternate embodiment namely pothole patching machine 300 is shown in a side schematic elevational view, wherein the previous container 102 is now a pressure vessel 302 allowing one to transfer the patch material 310 under pressure. A source of compressed air schematically shown as 304, communicates with pressure vessel 302 via a conduit 306. Thereby patch material 310 is delivered under pressure through delivery pipe 312 and into ram 116. In all other aspects ram 116 is similar if not the same as the machine shown in FIG. 1 through 5, other than the patching material is now more fluid in nature and therefore the computer control system 154 is adapted to take into consideration the viscosity of the patch material 310. The position sensor 150 and the force sensor 152 are calibrated to move the cylinder 118 at different input levels to ensure the correct amount of patch material 310 is delivered into the pothole 125 under foot plate 124. In all other aspects the machine is similar other than the properties of the patch material 310 which will have a significant effect upon the set up of the computer control 154. The compressibility of the patch material 310 will also affect the amount of material that is delivered as does the viscosity of the patch material 310.

Figure 8:
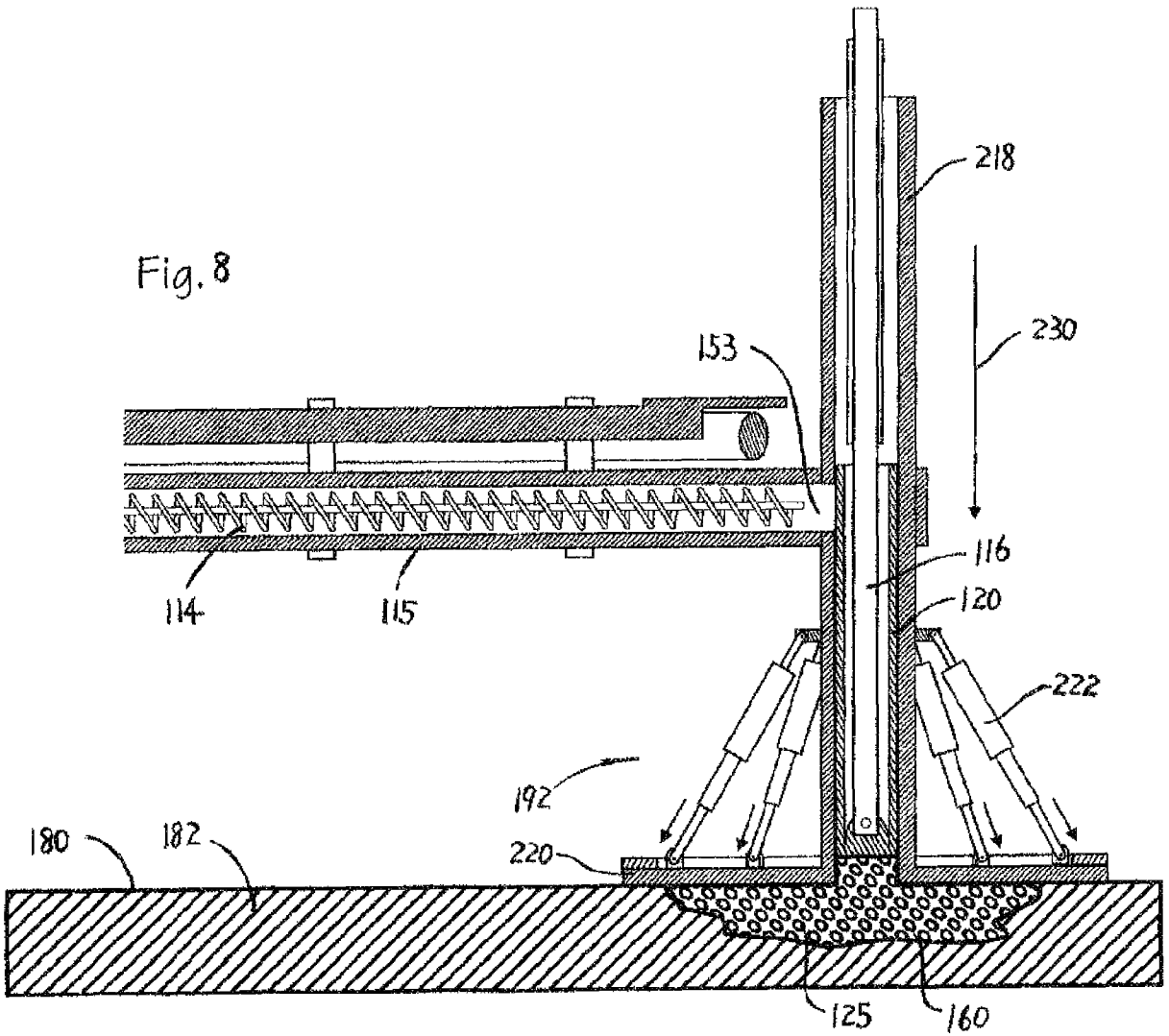
FIG. 8 is a side schematic partial cut away view of the portion of the Pothole Patching Machine showing the Ram footplate and screw conveyor wherein the footplate is placed onto the road surface of pavement using foot cylinders and the Ram is shown in the partially extended position.

Referring now to FIG. 8 in particular FIG. 8 is similar to FIG. 3 except it shows an alternate embodiment and variation of the Ram configuration. In all other aspects the embodiment shown in FIG. 8 is identical to the embodiment shown in FIGS. 1 through 5 with the exception that Ram 116 includes foot cylinders 222 depressing down onto a flexible footplate 220. In this embodiment the cylinder 218 is modified to accept foot cylinders 222 using a cylinder flange 224. The other components shown in FIG. 8 are identical to those shown in FIG. 4 for example except with the modifications as described here below.

A portion of an alternate embodiment Pothole Patching Machine 100 is shown in FIG. 8. Shown in FIG. 8 is the screw conveyor 114 the conveyor pipe 115 the opening 153 and a Ram 116 which includes a cylinder 218 a piston 120 foot cylinders 222 attached to a flexible footplate 220 and at the other end to a cylinder flange 224.

Piston 120 is shown in a partially extended position 192 wherein patching material 160 is almost completely emerged into the hole found in road service 180 at pavement 182.

Figure 9:
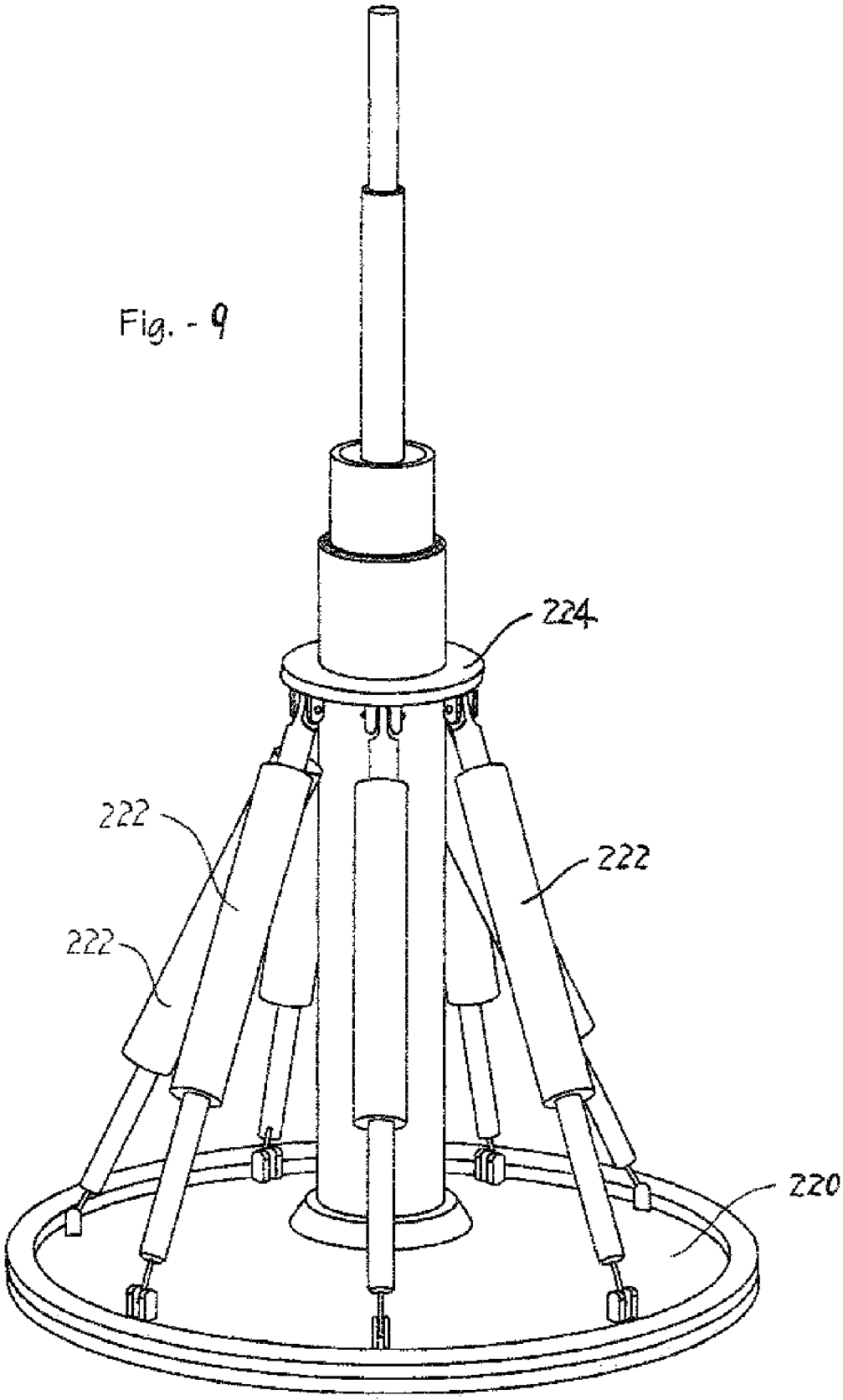
FIG. 9 is a schematic perspective view of a portion of the Pothole Patching Machine showing parts of the Ram particularly the foot cylinders footplate and cylinder flange.

FIG. 9 shows schematically the details of the modified Ram 116 which includes foot cylinders 222 a flexible footplate 220 and cylinder flange 224.

In the presently preferred embodiment depicted in FIGS. 8 & 9 together with the previous figures includes the major modification that the flexible footplate 220 is made of a flexible material in order to accommodate uneven road surfaces 180. The foot cylinders 222 provide a down force onto the rim of footplate 220 as shown in FIGS. 8 & 9 and flexible footplate 220 can accommodate unjulations and uneven road surfaces 180 and therefore create a tight seal around pothole 125 which is to be patched.

In the presently preferred embodiment shown in FIGS. 8 & 9 the computer control 154 will also include force sensors and each of the foot cylinders 222 which relays information back to the computer control 154.

Therefore in addition to the position sensor 150 and the force sensor 152 shown schematically on Ram 16 there are also additional force sensors not shown in FIGS. 8 & 9 internal to each of the foot cylinders 222 in communicating to computer control 154 the force being applied by each foot cylinder 222.

Therefore the computer control 154 can monitor the pressures between each of the foot cylinders 222 and upon reaching a certain pressure differential between any of the foot cylinders 222 the Ram 116 can be controlled to stop forcibly pushing patch material 160 into pothole 125. This is in addition to the control described for the embodiment depicted in FIGS. 1 through 5.

Any number of foot cylinders 222 can be used depending upon the size of and diameter of flexible footplate 220. There can for example be as little as three foot cylinders and as many as 12 depending upon the diameter and size of the footplate being utilized.

The flexible footplate 220 can be made of any suitable material provided that the footplate is flexible enough to accommodate unjulations and unevenness in road surface 180.

Not shown in any of the figures however contemplated by this concept is the use of vacuum machines to clean out the pothole prior to patching and also the potential of a heating attachment to soften the existing asphalt or dry out the hole before the repair begins. It is contemplated that various attachments to a support bracket 132 could be included such as a vacuum attachment and/or heating attachments which could vacuum out the hole and/or heat the material in around pothole 125 in order to dry out prior to installing patch material 160.

It should be apparent to persons skilled in the arts that various modifications and adaptation of this structure described above are possible without departure from the spirit of the invention the scope of which defined in the appended claim.

I claim:

1. A pothole patching machine comprising:

a) a container for storage of patch material;

b) a means for conveying the patch material from the container to a ram, wherein the ram adapted to forcibly urge the patch material into a pothole;

c) the ram moveable between a retracted position and an extended position completing one fill stroke;

d) the ram includes a foot plate dimensioned for positioning over the pothole, and the ram including a piston and cylinder, adapted to forcibly urge patching material downwardly into the pothole such that the piston moving downwardly within the cylinder from the retracted position to the extended position;

e) wherein the ram including means for sensing when the pothole has been filled;

f) wherein the sensing means including a force sensor for measuring the force being applied by the ram and a position sensor for measuring the position of the piston wherein the sensors adapted to communicate the measured force and position information to a computer control.

2. The pothole patching machine claimed in claim 1 wherein the cylinder including a opening for receiving patch material there through and loading into the cylinder when the ram is in the retracted position.

3. The pothole patching machine claimed in claim 2 wherein the piston closing off the opening in the cylinder when the piston moving downwardly within the cylinder from the retracted position to the extended position.

4. The pothole patching machine claimed in claim 1 wherein the position sensor adapted to measure how far the piston has moved past a bottom of the foot plate indicating the pothole has not been completely filled.

5. The pothole patching machine claimed in claim 1 wherein the computer control adapted to estimate the amount of patch material required to just fill the pot hole in the next fill stroke based on the amount of patch material, the force measurements and the stroke measurements of the previous fill stroke.

6. The pothole patching machine claimed in claim 1 wherein the ram including multiple foot cylinders attached to the cylinder at one end and a flexible foot plate at the other end, wherein the foot cylinders applying down ward force onto the flexible foot plate.

7. The pothole patching machine claimed in claim 6 wherein each foot cylinder including a force sensor for measuring the force being applied by each foot cylinder and communicating the measured information back to the computer control.

8. The pothole patching machine claimed in claim 2 wherein the conveying means including an auger screw conveyer for conveying the patch material from the container to the opening of the cylinder.

9. The method of patching potholes including;

a) preselecting an amount of patch material for loading into a ram that will under fill a pothole;

b) forcible urge the patch material into the pothole using the ram which is moveable between a retracted position and an extended position and includes a cylinder and a piston;

c) measure the force on the ram as it travels from the retracted position to the extended position;

d) measure the position of the cylinder relative to the top of the road surface;

e) calculate the amount of patch material required to just fill the remainder of the pothole from the force and position information;

f) load the ram with an amount of patch material calculated to fill the remaining unfilled portion of the pothole;

g) repeat steps b to e h) in the event the pothole is still not completely filled repeat steps e to g above.

* * * * *